US006412793B2

(12) United States Patent
de France

(10) Patent No.: US 6,412,793 B2
(45) Date of Patent: Jul. 2, 2002

(54) INTERFACE ELEMENT USED IN SNOWBOARDING

(75) Inventor: Guillaume de France, Tullins (FR)

(73) Assignee: Emery SA, Saint Egreve (FR)

( * ) Notice: Subject to any disclaimer, the term of this patent is extended or adjusted under 35 U.S.C. 154(b) by 0 days.

(21) Appl. No.: 09/725,548

(22) Filed: Nov. 29, 2000

(30) Foreign Application Priority Data

Nov. 30, 1999 (FR) ..... 99 15064

(51) Int. Cl.[7] ..... A63C 5/00

(52) U.S. Cl. ..... 280/14.21; 280/14.22; 280/607

(58) Field of Search ..... 280/607, 602, 280/11.14, 636, 611, 14.21, 14.22, 14.24; 441/70

(56) References Cited

U.S. PATENT DOCUMENTS 5,671,939 A * 9/1997 Pineau ..... 280/602
5,775,717 A * 7/1998 Bobrowicz ..... 280/607
5,895,068 A * 4/1999 Doyle ..... 280/618
5,909,894 A 6/1999 Meader et al. ..... 280/623
6,113,113 A * 9/2000 Longoni et al. ..... 280/14.2
6,234,513 B1 * 5/2001 Busby, Jr. et al. ..... 280/602
6,296,258 B2 * 10/2001 Higgins et al. ..... 280/14.22
2001/0001520 A1 * 5/2001 Gyr ..... 280/14.22
2001/0002083 A1 * 5/2001 de France ..... 280/607

FOREIGN PATENT DOCUMENTS

EP 0612546 8/1994

* cited by examiner

*Primary Examiner*—J. J. Swann
*Assistant Examiner*—J. Allen Shriver
(74) *Attorney, Agent, or Firm*—Heslin Rothenberg Farley & Mesiti P.C.; Victor A. Cardona, Esq.

(57) ABSTRACT

Interface element used in snowboarding and intended to transmit the pressure exerted by the foot of the rider in the direction of the snowboard (1), said element having median longitudinal (5) and transverse (6) planes dividing the pressure zone (3, 4) into four quadrants (11–14), wherein two (11, 13) of the quadrants arranged diagonally have a rigidity greater than the two other quadrants (12, 14) so as to favor transmission of the pressure at the diagonal of the two quadrants of greater rigidity, said diagonal being intended to be oriented substantially perpendicularly to the longitudinal axis of the board.

8 Claims, 4 Drawing Sheets

INTERFACE ELEMENT USED IN SNOWBOARDING

BACKGROUND OF THE INVENTION

The invention relates to the area of sports such as skating, skiing and surfing and, more precisely, to "snow surfing", generally referred to as snowboarding. More particularly, it relates to means intended to transmit the pressure exerted by the foot of the rider in the direction of the board, said means being designed to optimize the localization of the forces and the behavior of the board.

DESCRIPTION OF THE PRIOR ART

As is known, snowboard bindings are mounted on the snowboard with a certain freedom of rotation, making it possible to adjust the angle of the median longitudinal plane of the binding corresponding to that of the foot, relative to the longitudinal axis of the board.

To adopt the most ergonomic position possible, it may in fact be necessary for the front and back foot to have a particular orientation relative to the board.

The orientation of the front and back foot may differ and may likewise vary depending on the type of method employed. Thus, in the "free-style" method of snowboarding, the orientation of the feet and therefore of the binding is further from the longitudinal axis of the board than for the alpine method of snowboarding, in which the feet are closer to the longitudinal axis of the board.

Furthermore, there are two possible orientations for the foot relative to the perpendicular to the longitudinal axis of the board.

In fact, certain riders prefer to place their left foot toward the front of the board. Riders who adopt this method are referred to as "regular".

Conversely, certain riders prefer to place their right foot toward the front of the board. Such riders are referred to as "goofy". As the back foot is generally more perpendicular to the longitudinal axis of the board than the front foot, it follows that the angle of the binding may vary greatly depending on whether it is used by a "goofy" or "regular" rider.

Furthermore, it has been observed that the forces are generally exerted from the binding in the direction of the board and localized essentially in the end zones of the binding, corresponding to the front of the foot for "front side" curves and the back of the foot on "back side" curves.

In other words, depending on the orientation of the binding relative to the board, the forces are exerted in an offset manner relative to the edges. The further the foot is from the perpendicular, the more the pressure is exerted in a zone remote from the edges and is thus less effective.

A first problem that the invention proposes to solve is that of optimizing the localization of the pressure exerted from the binding, whatever the orientation of the binding relative to the longitudinal axis of the board.

Furthermore, in the most frequent case where the binding is not perpendicular to the longitudinal axis of the board, the two zones of transmission of the pressure from the binding toward the board, which are situated at the front and back of the foot, are offset longitudinally relative to the board. It follows that the part of the binding situated between these two pressure zones has a rigidity which is added to and combined with the intrinsic rigidity of the board.

This combination has the effect of modifying the intrinsic mechanical strength characteristics of the board and takes it away from its theoretical behavior. Such a modification is prejudicial to the board's resistance to the forces.

In particular, numerous cases have indeed been observed in which the board has broken in the end zones of the binding due to the occurrence of excessive stresses during bending of the board.

Another problem which the invention proposes to solve is that of loosening the binding relative to the board and reducing the influence of the mechanical rigidity of the binding on the intrinsic mechanical properties of the board.

It is therefore the object of the invention to allow optimization of the pressure exerted on the binding in the direction of the board while allowing a certain loosening of the rigidity of the binding and the board and at the same time retaining compatibility with the freedom of adjustment of the orientation of the binding relative to the longitudinal axis of the board in accordance with the different methods and different types of user.

SUMMARY OF THE INVENTION

The invention thus relates to an interface element used in snowboarding and intended to transmit the pressure exerted by the foot of the rider in the direction of the snowboard. Such an element has median longitudinal and transverse planes dividing the pressure zone into four quadrants.

This element is distinguished by the fact that two of the quadrants arranged diagonally have a rigidity greater than the two other quadrants so as to favor transmission of the pressure at the diagonal of the two quadrants of greater rigidity.

In other words, on a snowboard fitted with the characteristic interface element the pressure exerted by the user is not localized along the median longitudinal plane of the boot and of the binding but instead in a manner offset transversely.

The diagonal of the two quadrants of greater rigidity is advantageously oriented perpendicularly to the longitudinal axis of the board in such a way that the quadrants of greater rigidity are close to the edges, improving the precision with which the board can be guided.

In other words, in accordance with the invention the volume enclosed between the foot of the user and the upper face of the board has a rigidity which is distributed in such a way that the pressure is transmitted preferentially in a direction perpendicular to the longitudinal axis of the board.

Moreover, thanks to the characteristic interface element the mechanical influence of the area of pressure on the board is essentially limited to a reduced zone in the longitudinal direction of the board to the two quadrants of greater rigidity. In this way, the effect of the rigidity of the binding and of the members associated with it is relatively small during the bending of the board. The latter thus retains its intrinsic mechanical properties and its optimum behavior.

In practice, numerous embodiments make it possible to obtain a structure that favors pressure along the characteristic diagonal.

Thus, according to a first group of embodiments, the characteristic element can be formed by a spacer element placed between the binding and the upper face of the snowboard. This is then an interface plate intended to raise the binding. The rigidity of this spacer element varies over its area and is greater along a characteristic diagonal.

Thus, in a first variant, the spacer element can have two plugs of greater rigidity than the remainder of the element, which are incorporated into its structure in the two quadrants arranged diagonally.

In this way, when the binding is arranged on this spacer element, the forces exerted by the skier are essentially transmitted in the zones of greater rigidity, while the zones of lower rigidity deform and are compressed.

In another embodiment, the spacer element has at least two protruding parts intended to be embedded in complementary openings provided for this purpose in the seat of the binding.

In this way, the user's boot is in contact with the spacer element in the two quadrants of greater rigidity, and the forces are thus transmitted directly via the protruding parts.

According to another embodiment, the seat of the binding can have protruding zones in the two quadrants of greater rigidity, these protruding zones making contact with the upper face of the board in two zones situated perpendicularly relative to the longitudinal axis of the board.

To take account of the different orientations corresponding to the "goofy" and "regular" methods, the same characteristic interface element is suitable for use in accordance with the two different orientations of the foot relative to the board, by being turned around for example.

In another case under consideration allowing dual use, such an element has two series of four quadrants, each series being dedicated to one orientation of the foot relative to the board and having quadrants of greater rigidity on a diagonal different from the diagonal of greater rigidity of the other series, the two series having two quadrants in common.

In other words, such an element has six elementary zones intended to form quadrants, four of these zones being used in the "regular" position and the two other zones being used with two of the first in the "goofy" method.

In another embodiment, the interface element can be incorporated directly into the sole of the user's boot, in which case the sole of the boot has elements of greater rigidity arranged on a diagonal passing through the median longitudinal plane of the boot.

BRIEF DESCRIPTION OF THE DRAWINGS

The way in which the invention is embodied and the advantages which result will emerge clearly from the description of the embodiments below with reference to the attached figures, in which.

DESCRIPTION OF THE PREFERRED EMBODIMENTS

As already stated, the invention relates to interface elements intended to transmit the pressure exerted by the foot of the rider in the direction of the board in a preferential direction corresponding substantially to a diagonal of the binding and oriented perpendicularly to the longitudinal axis of the board.

In this way, the pressure is exerted as close as possible to the edges, increasing the precision with which the board can be guided and, on the other hand, allowing a certain loosening of the binding relative to the board.

Figure 1:
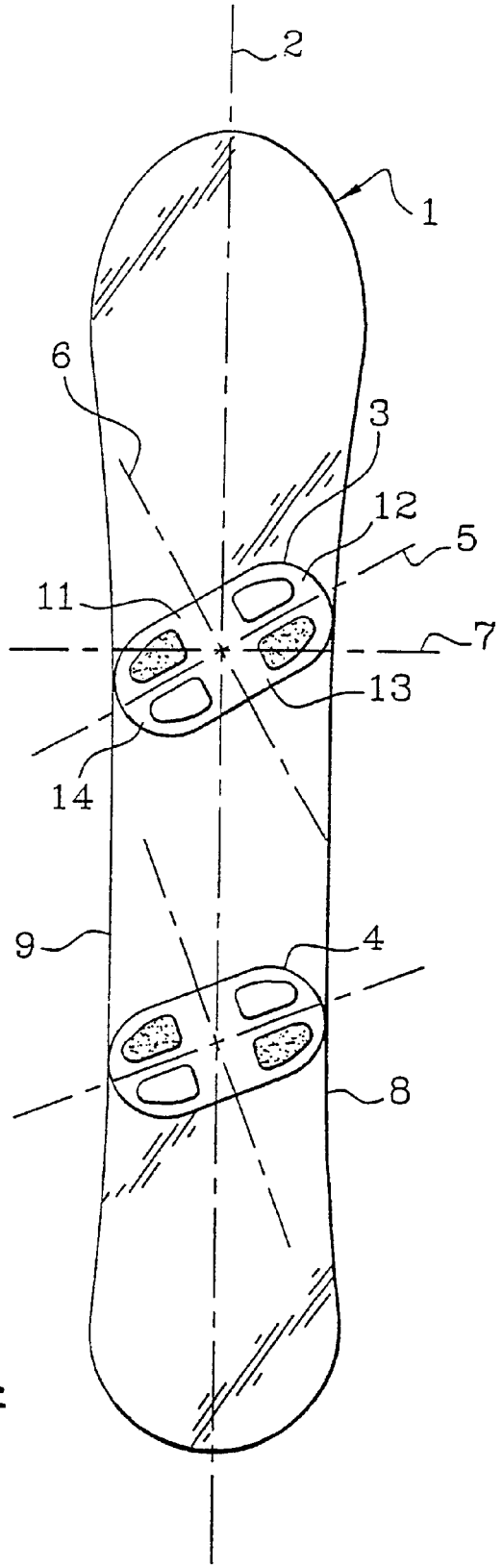
FIG. 1 is a plan view of a snowboard, on which the pressure zones of the binding are represented in a schematic way.

As illustrated in FIG. 1, the board (1) has a median longitudinal axis (2) and two locations (3, 4), on which the bindings intended to receive the boots of the user are mounted.

According to the invention, such pressure zones (3, 4) have a median longitudinal plane (5) separating the binding of the boot into two parts, left and right respectively.

This median longitudinal plane (5) generally deviates from the perpendicular (7) to the median longitudinal axis (2) of the board (1) for reasons of ergonomics. Thus, as already stated, this angle can vary depending on whether the board is used for alpine boarding or for a "free-style" method.

Moreover, the user will align his or her foot on one side or the other of the perpendicular (7) to the longitudinal axis (8) of the board (1), depending on whether he or she is "regular" (as illustrated in FIG. 1) or "goofy".

According to one characteristic of the invention, the space between the user's foot and the upper face of the board forms a pressure zone (3, 4), which is divided into four quadrants (11–14) along the longitudinal median plane (5) and the transverse median plane (6).

According to one characteristic of the invention, two of these four quadrants (11, 13) have a greater rigidity than the two others (12, 14) and are arranged diagonally in such a way that they are situated close to the edges (8, 9).

Such an arrangement thus allows the pressure to be transmitted essentially close to the edges (8, 9), improving the accuracy with which the board can be guided.

Moreover, the transmission of the pressure is essentially concentrated in the two quadrants (11, 13) of greater rigidity, which means that the two other quadrants (12, 14) allow a certain latitude or a certain capacity for movement of the board relative to the binding (1). By virtue of this characteristic, the stresses exerted by the binding on the board (1) are relatively limited and the binding is thus loosened relative to the board.

Numerous architectures and structures can be used to form pressure zones in accordance with the invention, this forming the subject matter of the four descriptions below.

First Embodiment of the Invention

Figure 2:
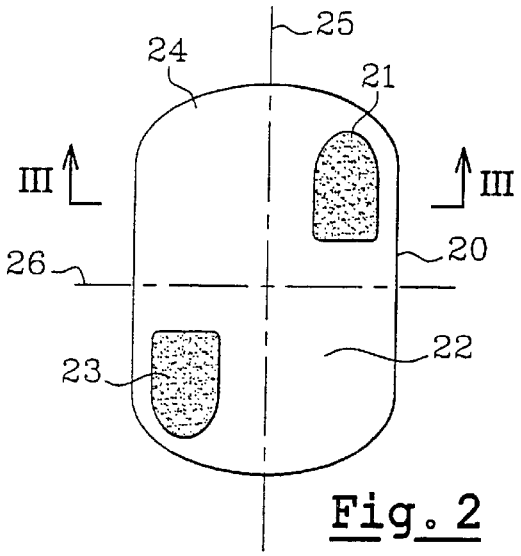
FIG. 2 is a plan view of a spacer plate corresponding to a first method of implementing the invention.
Figure 3:
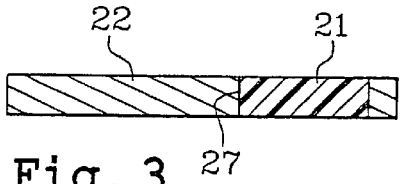
FIG. 3 is a view in section in the plane III–III' in FIG. 2.

As illustrated in FIGS. 2 and 3, the interface element can take the form of a spacer element (20) placed between the binding and the upper face of the board. Such an element (20) has dimensions similar to those of the binding seat.

According to one characteristic of the invention, it has zones (21, 23) of greater rigidity positioned on each side of the median longitudinal (25) and transverse (26) planes.

More precisely, the spacer plate (20) illustrated in FIG. 2 has two zones (21, 23) formed by a material different from the remainder (22, 24) of the plate and forming rigid plugs made of thermoplastic material, e.g. polyurethane, polypropylene or polyamide, while the remainder of the plate is formed by a material such as a cellular foam, for example.

This plate can be manufactured by multi-injection or thermocompression.

The plugs (21, 23) can be formed independently of the remainder of the plate (20), which then forms receptacles (27), which may or may not penetrate the plate, made for this purpose and intended to receive the plugs (21, 23).

The geometry of the plugs (21, 23) and their positioning can be optimized to obtain the best possible transmission of the forces and is not limited to the form illustrated in FIGS. 2 and 3. In one variant, the plugs may not penetrate the flexible material completely so as to enhance user comfort.

Figure 4:
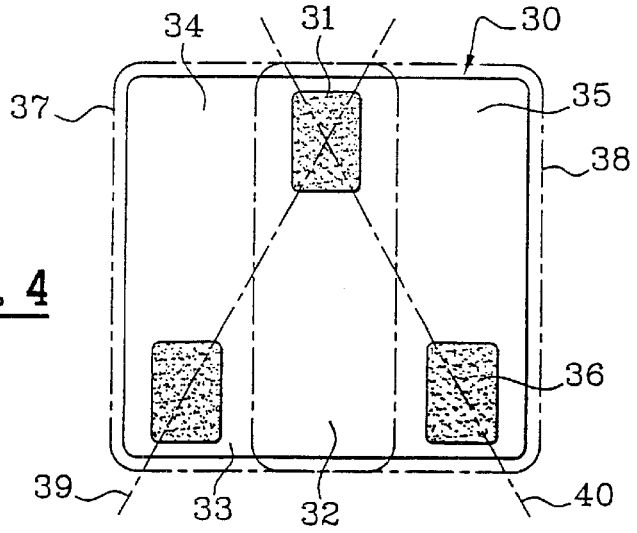
FIG. 4 is a plan view of a spacer plate corresponding to a variant implementation of the first embodiment.

To allow the same interface element to be used for the two boarding methods, namely "goofy" and "regular", the interface element (20) can be either symmetrical, as illustrated in FIG. 3, to allow it to be turned around and provide zones of greater rigidity in opposing quadrants or can have a more complex geometry, as illustrated in FIG. 4.

More precisely, in the case under consideration the interface plate (30) has six quadrants (31–36), four (31–34) of which correspond to a position (37) in which the diagonal (39) of greater rigidity is oriented in a certain direction.

The other series of four quadrants (31, 32, 33, 36), which shares the two central quadrants (31, 32) with the above series, has a diagonal (40) of greater rigidity oriented in the opposite direction. In this way, when the plate (30) is used in accordance with one method, the binding is arranged above the four corresponding quadrants while, when the plate (30) is used for a binding arranged in accordance with the other methods the binding is then mounted perpendicularly with respect to the other series (38) of quadrants.

The remainder of the plate does not interfere with the binding and does not prevent loosening.

Second Embodiment of the Invention

Figure 5:
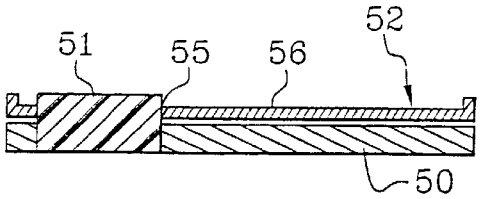
FIG. 5 is a view in longitudinal section of a spacer plate and of a binding seat corresponding to a second embodiment of the invention.
Figure 6:
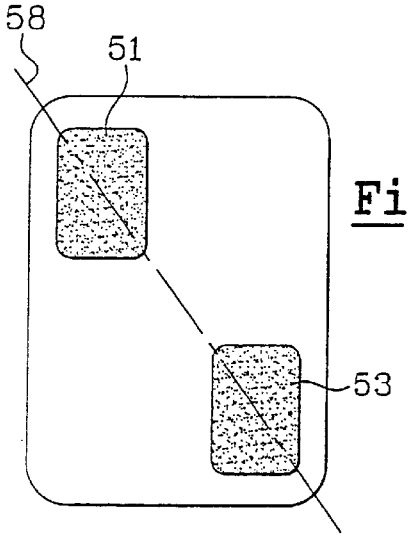
FIG. 6 is a plan view of the spacer plate in FIG. 5.

As illustrated in FIGS. 5 and 6, the interface element can be formed by a plate (50) arranged under the seat (52) of the binding and having at least two protruding parts (51, 53) intended to be embedded in the complementary openings (55) arranged in said seat (52) for this purpose. For the purpose of simplification and to avoid limitation to a single type of binding, only the seat has been shown. It is self-evident that the invention applies to all types of binding, such as that with a flexible or alpine shell, whatever the means of retaining the boot in the binding.

More precisely, the protruding zones (51, 52) can be formed by plugs similar to those illustrated in FIGS. 2 and 3 but with a thickness markedly greater such that they appear at the upper face (56) of the seat (52) on which the sole of the boot comes to rest.

In this way, these protruding zones (51, 52) come into direct contact with the sole of the boot and accept the pressure, which they transmit directly in the direction of the board at the characteristic diagonal (58).

In an embodiment which is not shown but is derived from that illustrated in FIGS. 5 and 6, the plate situated under the seat of the binding has two additional protuberances, formed by a material which is more compressible than that forming the rigid protruding plugs, in such a way as to project into additional openings formed in the seat.

In this embodiment, the various protruding zones can be formed by added elements placed in a base plate comprising receptacles so as to allow the arrangement of the plugs of greatest rigidity to be modified, thus modifying the orientation of the diagonal of greatest rigidity.

In this case, the geometry of the plugs and of the corresponding receptacles in the base plate has a certain symmetry.

Third Embodiment

Figure 8:
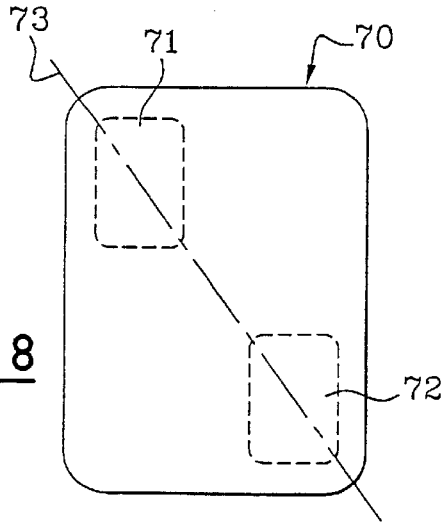
FIG. 8 is a plan view of the seat of the binding in FIG. 7.
Figure 7:
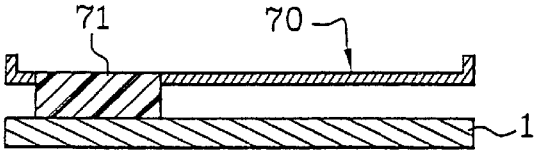
FIG. 7 is a view in longitudinal section of a seat and of a snowboard in accordance with a third embodiment of the invention.
Figure 9:
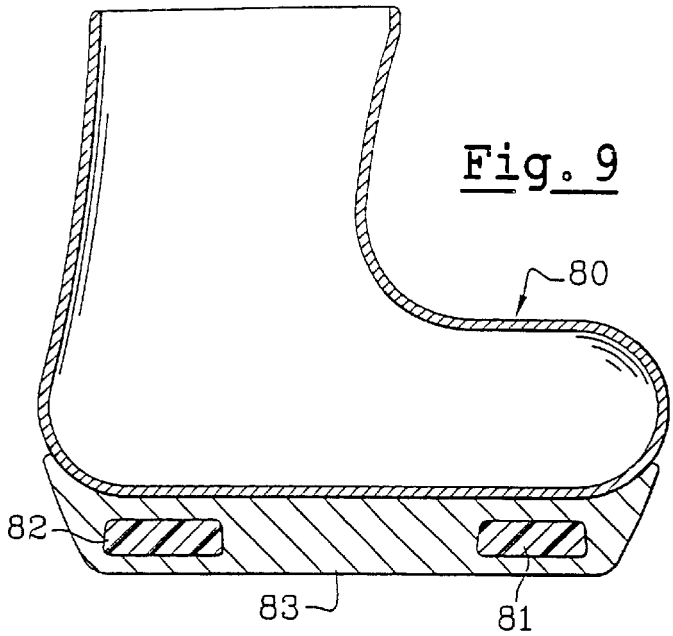
FIG. 9 is a schematic view in longitudinal section of a boot corresponding to a fourth embodiment of the invention.
Figure 10:
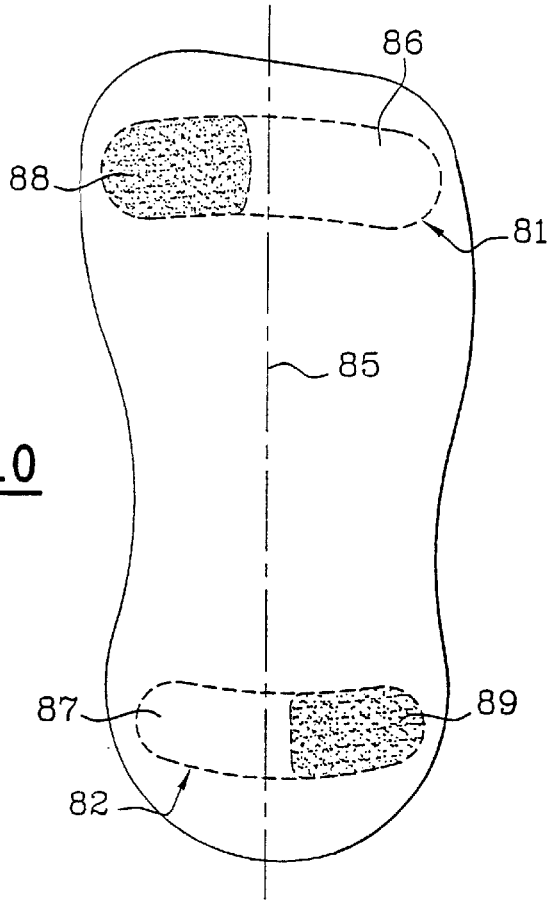
FIG. 10 is a bottom view of the boot in FIG. 9.

As illustrated in FIGS. 7 and 8, the interface element can be formed by protuberances (71, 72) of the seat (70) of the binding itself, and intended to form zones of contact between the seat (70) and the board (1) proper.

In this way, the binding (70) rests on the board (1) only in the two protruding zones (71, 72). The forces exerted by the user are thus transmitted to the board exclusively in these zones of contact (71, 72).

The space between the seat (70) and the upper face of the board (1) can of course be filled with a compressible foam so as to avoid the introduction of a wedge of snow under the seat of the binding.

To allow the use of a binding featuring the characteristic optimization of the transmission of the forces, provision can be made for the seat of the binding to accept added pieces arranged on one or other of the diagonals depending on the method practiced by the user. Means of fixing the protruding elements on the seat are then provided.

Fourth Embodiment of the Invention

Optimum transmission of the forces close to the edges, even when the foot is inclined relative to the perpendicular to the longitudinal axis of the board can likewise be achieved by arrangements implemented within the user's boot itself.

More precisely, such a boot (80) can have two transverse inserts (81, 82) at the front and rear of the sole (83) in the manner of the boot (60) described in French patent application FR 98/15 088. In accordance with the invention, such inserts (81, 82) can have increased rigidity on one side or the other of the median longitudinal plane (85) of the boot.

More precisely, such inserts (81, 82) can be formed by a material similar to the remainder of the sole (83) on one side (86), while the other end (86) of the insert is formed by a more rigid material. The opposite arrangement (87, 89) is used for the opposite insert (82).

In a different embodiment, the inserts do not extend over virtually the entire thickness of the sole but, on the contrary, the sole (83) has localized zones exclusively at the characteristic diagonal formed by plugs of greater rigidity.

Such plugs can be either incorporated within the sole formed by molding or can be added to the underneath of the sole. These plugs can be symmetrical to allow them to be turned around according to whether the boot is used for the "goofy" or "regular" method.

It will be evident from the above that the snowboarding means in accordance with the invention have numerous advantages, in particular:

- optimization of the localization of the forces close to the edges, whatever the orientation of the foot relative to the longitudinal axis of the board, enhancing steering and accuracy;
- a certain loosening of the binding relative to the ski, giving the board equipped with bindings its mechanical and intrinsic properties.

What is claimed is:

1. An interface element used in snowboarding and intended to transmit the pressure exerted by the foot of the rider in the direction of the snowboard (1), said element having median longitudinal (5) and transverse (6) planes dividing the pressure zone (3, 4) into four quadrants (11–14), wherein two (11, 13) of the quadrants arranged diagonally have a rigidity greater than the two other quadrants (12, 14) so as to favor transmission of the pressure at the diagonal of the two quadrants of greater rigidity, said diagonal being intended to be oriented substantially perpendicular to the longitudinal axis of the board.

2. The element as claimed in claim 1, wherein said element is formed by a spacer element (20) placed between the binding and the upper face of the snowboard.

3. The element as claimed in claim 2, wherein the spacer element (20) has two plugs (21, 23) of greater rigidity than the remainder of the element (20), which are incorporated into its structure in the two quadrants arranged diagonally.

4. The element as claimed in claim 2, wherein the spacer element (50) has at least two protruding parts (51, 53) intended to be embedded in complementary openings provided for this purpose in the seat (52) of the binding.

5. The element as claimed in claim 4, wherein the two protruding parts (51, 53) form the zones of greater rigidity.

6. The element (30) as claimed in claim 2, which is suitable for use in accordance with two different orientations of the foot relative to the board, wherein said element has two series of four quadrants (31–36), each series (31, 32, 33, 34; 31, 32, 35, 36) being dedicated to one orientation of the foot relative to the board and having quadrants (31, 33; 31, 36) of greater rigidity on a diagonal (39) different from the diagonal (40) of greater rigidity of the other series, the two series having two quadrants (31, 32) in common.

7. The element as claimed in claim 1, wherein the interface element is formed by protruding parts (71, 72) arranged in the seat (70) of the binding and intended to make contact with the upper face of the board in two zones situated perpendicularly relative to the longitudinal axis of the board.

8. The element as claimed in claim 1, wherein said element is formed at least in part by the sole (83) of the boot (89) of the user.

* * * * *